United States Patent [19]

Kilthau

[11] 4,153,746

[45] May 8, 1979

[54] METHOD OF SENSITIZING COPPER SURFACES WITH SENSITIZING SOLUTION CONTAINING STANNOUS IONS, PRECIOUS METAL IONS AND EDTA

[75] Inventor: Hans D. Kilthau, Boeblingen, Fed. Rep. of Germany

[73] Assignee: International Business Machines Corporation, Armonk, N.Y.

[21] Appl. No.: 861,332

[22] Filed: Dec. 16, 1977

[30] Foreign Application Priority Data

Dec. 30, 1976 [DE] Fed. Rep. of Germany ..... 2659680

[51] Int. Cl.[2] ..... C23C 3/02

[52] U.S. Cl. ..... 427/304; 106/1.11; 427/305; 427/306; 427/98

[58] Field of Search ..... 427/304, 305, 306, 98; 106/1.11

[56] References Cited

U.S. PATENT DOCUMENTS

| | | | |
|---|---|---|---|
| 3,011,920 | 12/1961 | Shipley | 427/304 |
| 3,627,558 | 12/1971 | Roger et al. | 427/305 |
| 3,650,959 | 3/1972 | Shipley et al. | 252/79.4 |
| 3,672,938 | 6/1972 | Zeblisky | 427/306 |

FOREIGN PATENT DOCUMENTS 2153563 5/1972 Fed. Rep. of Germany.

*Primary Examiner*—John D. Smith

*Attorney, Agent, or Firm*—Wolmar J. Stoffel

[57] ABSTRACT

A method of sensitizing surfaces which at least include areas of copper for subsequent electroless plating wherein the surface to be sensitized is processed with a sensitizing bath which includes precious metal ions, stannous ions in stoichiometric surplus, a haloid acid, and a complex forming compound for copper ions.

4 Claims, No Drawings

METHOD OF SENSITIZING COPPER SURFACES WITH SENSITIZING SOLUTION CONTAINING STANNOUS IONS, PRECIOUS METAL IONS AND EDTA

BACKGROUND OF THE INVENTION

The present invention relates to a method of sensitizing surfaces for the subsequent electroless metallization, where the surface to be sensitized is processed with a sensitizing solution containing precious metal ions and stannous ions in stoichiometric surplus and a haloid acid.

A plurality of processes are known for sensitizing surfaces of different types, for instance synthetic material surfaces, for the subsequent electroless metallization.

In the manufacture of printed conductive panels it is for instance already known to process the synthetic surfaces to be metallized at first either with a stannous solution or with a precious metal salt solution in order to sensitize them for the electroless metal deposition. It is furthermore known to process the respective surfaces first with a tin (II)-chloride solution and to immerse them subsequently, after careful rinsing, in a bath containing precious metal ions, e.g. in a bath containing silver nitrate, or chlorides of gold, palladium, or platinum for carrying out the sensitization.

It is known from German Pat. No. 1,197,720 (U.S. Pat. No. 3,011,920) to use a fluid for sensitizing which contains colloidal silver, gold, or a metal of the platinum group, as well as colloidal stannic acid as protective colloid for the precious metal colloid. It is also known from German Auslegeschrift 1,446,224 (U.S. Pat. No. 3,672,938) to use, for the sensitizing of metallic and non-metallic surfaces for the subsequent electroless metal deposition, an acidic aqueous solution containing precious metal ions and stannous ions in stoichiometric surplus to the precious metal ions.

A great disadvantage of the hitherto known processes is that the sensitizing baths containing precious metal compounds require an exact and careful process control and may lead to a deposition of precious metal layers on the synthetic or metallic surfaces exposed to the sensitizing baths, which is the reason for an insufficient adherence of the metal layers subsequently deposited thereon; and that due to precious metals being lost the sensitizing baths are expensive. Furthermore a particular disadvantage is that the formerly known sensitizing baths are of a rather low stability because simultaneously with the catalyzing of synthetic surfaces there is a reaction between the sensitizing baths and the copper foil surface, so that copper (II) ions reach the sensitizing bath and deactivate it.

SUMMARY OF THE INVENTION

The present invention avoids the above disadvantages, the invention having the object of making the catalytical sensitizing of synthetic surfaces for electroless metallization simpler, safer to operate, and more economical, and of providing as economically as possible precious metal salt-containing sensitizing baths of high activity.

The object is achieved in accordance with the invention by a process of the above specified type which is characterized in that for obtaining a constant activity a complex-forming compound for copper ions is admixed to the sensitizing bath one or several times during use.

In an advantageous embodiment of the invention ethylene diamine tetra-acetic acid or an alkali metal salt thereof is used as complex forming compound.

In the process as disclosed by the invention the admixture of the complex forming compound to the sensitizing bath during use presents a sensitizing bath with continuous activity. Besides, the bath shows an excellent stability, and because of its economic application it can also be employed on a large scale.

The invention will be described in detail below in the following specific description.

DESCRIPTION OF PREFERRED EMBODIMENTS

In the process as disclosed by the invention a complex forming compound for copper ions is admixed to the sensitizing bath. Ethylene diamine tetra-acetic acid or an alkali metal salt thereof has proved to be a particularly advantageous complex forming compound. That this complex forming compound effects an excellent bath stability of acidic baths is surprising because ethylene diamine tetraacetic acid (EDTA) metal complexes, as specified below, are considered stable in an alkaline medium only. For instance, complex forming compounds of the above mentioned type have long been admixed to alkaline baths for the electroless deposition of copper coatings on surfaces of metals, ceramic, synthetics, etc. quite successfully. As specified in R. Pribil, Komplexometrie, Vol. 1, 2nd edition 1963, VEB Deutscher Verlag fur Grundstoffindustrie, p. 26, the apparent complex forming constant pK' which is a measure for the stability of the complex has, at a pH value of 10 to 11 a value of approximately 19, and a pH value of 7 it sinks to approximately 15, and at a pH value of 1 it sinks to a value of less than 2, i.e. by the admixture of EDTA to acidic solutions no remarkable complexing effect will be obtained. Inspite of that, the admixture of EDTA to a sensitizing bath in accordance with the invention which has a pH value of less than 1 brought a considerable increase of the stability and consequently of the lifetime of the sensitizing bath.

It has proved advantageous to admix to the sensitizing bath the complex forming compound (EDTA, EDTA sodium salt) already prior to its first use in a quantity of up to 2 gr. per liter bath fluid. During the use of the sensitizing bath the copper contents of the bath increase due to the processing of copper-coated parts. In an experimental bath a copper content of approximately 12 mg/liter caused the inactivity of the bath so that a copper-deposition in the through-holes of the conductive panels was no longer possible. It was found that the copper content which inactivates the sensitizing bath also depends on the tin (II)-chloride content of the bath. When a bath with a lower tin (II)-chloride content was employed it became inactive at an even lower copper ion concentration.

The copper ion concentration which renders the sensitizing bath inactive to the extent that a subsequent copper-deposition in the through-holes of the conductive panels is no longer possible can be determined by means of uncomplicated tests. When the bath activity, decreases complex forming compounds have to be added to the bath. In an experiment to evaluate the invention embodiment for instance, after about 300 parts have passed through a conventional sensitizing bath, EDTA sodium salt was admixed to the bath in such a quantity that a concentration of 5 gr./liter bath fluid was obtained. The admixture of the complex forming compound was repeated after about 550 parts had passed through. It should be pointed out that it was not possible to find out by analysis whether the copper is present in the highly acidic sensitizing solution in the form of an EDTA complex.

A complex forming compound can be admixed to known sensitizing baths which contain precious metal ions, stannous tin ions, and haloid acid. Suitable precious metal salts for such sensitizing baths, for instance, salts of palladium, platinum, gold, rhodium, osmium, iridium, and mixtures thereof. Examples of the salts of these metals, and of tin are chlorides, bromides, fluorides, fluoroborates, iodides, nitrates, sulfates, and acetates. Of these salts, the chlorides are particularly suitable. The concentration of the precious metal ions in the sensitizing bath fluid can vary from approximately 0.01 to 5.0 gr. per liter fluid. The concentration of the stannous ions can vary within wide limits but it has always to be in a stoichiometric surplus with respect to the precious metal ions in the bath fluid. It has proved advisable to provide a large surplus of, for instance, stannous chloride. The bath fluid also contains a suitable acid. Hydrochloric acid, hydrofluoric acid, fluoboric acid, and acetic acid are particularly advantageous. The acid concentration in the sensitizing bath depends largely on the strength of the acid used. However, it should not be less than 0.0001 n. When strong acids are used an acid concentration between 0.02 and 5 n is preferred.

A particularly advantageous composition of a sensitizing bath is as follows:

EXAMPLE I

| | |
|---|---|
| Palladium chloride ($PdCl_2$) | 0.5 to 0.7 g/l |
| Stannous chloride ($SnCl_2 \cdot 2H_2O$) | 25 to 30 g/l |
| Hydrochloric acid (HCl, 37%) | 300 to 400 ml/l |
| Complex forming compound (EDTA, EDTA sodium salts) | up to 2 g/l. |

The sensitizing bath is made by first dissolving the palladium chloride in an aqueous hydrochloric acid solution. The stannous chloride is also dissolved in concentrated hydrochloric acid. Prior to use, both solutions are brought together and heated to boiling point for about two hours. When the solutions are brought together there is a violet coloring which toward the end of the heating process changes into a dark-brown coloring which indicates that the solution is ready for use. If necessary, the solution is diluted in order to obtain the respective concentrations, and the hydrochloric acid content is regulated accordingly, and the complex forming compound is admixed. After heating and diluting and the admixture of the complex forming compound the bath is ready for use. Depending on the concentration of the precious metal ions the sensitizing period in the bath is approximately 1 to 5 minutes.

The process as disclosed by the invention can be applied as described below. On a coated carrier sheet consisting of metal foil and polymerized resin layers an approximately 5 μm thick copper foil is laminated on both sides. This 5 μm copper foil is arranged on an approximately 50 μm thick carrier foil of copper, and is processed together therewith. After lamination the through-holes are made in the carrier sheet for instance by means of punching or boring. The conductive panels are cleaned and sensitized through immersion into the above described sensitizing solution. This process takes 2 minutes approximately. Subsequent to sensitizing the 50 μm thick copper carrier foil is stripped off, and the surface is rinsed with water. In a photolithographic process a mask corresponding to the respective circuit pattern is produced on the conductive panel. Those areas not covered by the photoresist which correspond to the circuit pattern, and also the through-hole walls are coated by means of electroless plating with a copper layer which shows the layer thickness required. Subsequently, the photoresist is removed. By applying an etchant the approximate 5 μm thick copper foil coating which is not part of the circuit is removed in the bared areas.

In a sensitizing bath with an admixture of EDTA sodium salt, and in a bath without such an admixture 25 copper-plated and punched standard conductive panels are respectively sensitized each day, and subsequently copper-plated in a copper-deposition bath containing copper ions, sodium hydroxide, formaldehyde, and sodium cyanide, for one hour. The sensitizing bath not containing any complex forming compound had become inactive after only 3 days, i.e. owing to its high copper ion contents it did no longer permit a perfect sensitization for the subsequent copper plating. The sensitizing bath containing complex forming complex forming compound had not lost any of its activity, and after its use excellent results could be obtained in the copper-plating of the through-hole walls.

The sensitizing bath which was used for sensitizing the through-hole walls of epoxy resin was analyzed prior to its use. Another analysis was made after 25 standard conductive panels has passed through. The content of complex forming compound in the sensitizing bath could not be determined because no suitable method of analysis was known. The analysis results are given below:

| Analysis Values: | Fresh Mixture | After 25 Parts Have Passed Through |
|---|---|---|
| Palladium chloride ($PdCl_2$) | 708 mg/l | 660 mg/l |
| Stannous chloride ($SnCl_2 \cdot 2H_2O$) | 25.1 g/l | 26.6 g/l |
| $Sn^{4+}$ | 4.3 g/l | 5.1 g/l |
| Hydrochloric acid (HCl, 37%) | 351 ml/l | 343 ml/l |
| Copper Ion Content | 12 mg/l+) | 14.5 mg/ |
| Complex Forming Compound | not analyzed | not analyzed |

+)copper content of the fresh mixture due to preliminary tests

The fresh mixture of the sensitizing bath with the above given composition had lost so much activity due to the copper ion content that without an admixed complex forming compound it had become inactive. By adding a complex forming compound the activity of the bath can be maintained and thus its lifetime can be extended, the admixture of the complex forming compound, depending on each particular case, taking place one or several times.

What is claimed is:

1. In a method of sensitizing surfaces which include areas of copper for the subsequent electroless metallization, where the surface to be sensitized is processed with a sensitizing solution with a pH of less than 1 containing precious metal ions, stannous ions in stoichiometric surplus, and a haloid acid, the improvement comprising; admixing to the sensitizing bath a complex forming compound for copper ions selected from the group consisting of ethylene diamine tetra-acetic acid and alkali metal salts of ethylene diamine tetra-acetic acid to thereby maintain a low concentration of free copper ions and contacting said surfaces with said sensitizing bath.

2. The method as claimed in claim 1, wherein the complex forming compound is used in a concentration of at least 1 g/l.

3. The method of claim 1 wherein said precious metal ions in said sensitizing bath are selected from the group consisting of palladium, platinum, gold, rhodium, osmium, iridium, and mixtures thereof.

4. The method as claimed in claim 1, wherein a sensitizing bath containing palladium chloride, stannous chloride in stoichiometric surplus, hydrochloric acid, and ethylene diamine tetra-acetic acid-sodium salt is used.

* * * * *